US012753003B2

(12) United States Patent
Millsaps

(10) Patent No.: US 12,753,003 B2
(45) Date of Patent: Oct. 6, 2026

(54) APPARATUS AND METHOD FOR STEMMING BLAST HOLES

(71) Applicant: James W. Millsaps, Englewood, TN (US)

(72) Inventor: James W. Millsaps, Englewood, TN (US)

( * ) Notice: Subject to any disclaimer, the term of this patent is extended or adjusted under 35 U.S.C. 154(b) by 380 days.

(21) Appl. No.: 18/507,398

(22) Filed: Nov. 13, 2023

(65) Prior Publication Data

US 2024/0270485 A1 Aug. 15, 2024

Related U.S. Application Data

(60) Provisional application No. 63/445,312, filed on Feb. 14, 2023.

(51) Int. Cl.

| | |
|---|---|
| ***B65D 90/58*** | (2006.01) |
| ***B65D 88/26*** | (2006.01) |
| ***B65D 88/56*** | (2006.01) |
| ***B65D 88/66*** | (2006.01) |
| ***F42D 1/08*** | (2006.01) |

(52) U.S. Cl.

CPC ..... *B65D 90/587* (2013.01); *B65D 88/26* (2013.01); *B65D 88/56* (2013.01); *B65D 88/66* (2013.01); *F42D 1/08* (2013.01)

(58) Field of Classification Search

CPC ..... B65D 88/26; B65D 88/30; B65D 88/56; B65D 88/66; F42D 1/08; B65G 67/20; E02F 3/4075; E02F 3/407; E02F 3/404; E02F 3/40; E02F 3/962; E04G 21/0481

See application file for complete search history.

(56) References Cited

U.S. PATENT DOCUMENTS

| | | | | |
|---|---|---|---|---|
| 1,562,929 | A | 11/1925 | Trovaton | |
| 2,986,294 | A * | 5/1961 | Granryd | E02F 3/401 37/447 |
| 3,341,041 | A | 9/1967 | Salna | |
| 3,344,540 | A | 10/1967 | Ulrich | |
| 3,598,266 | A | 8/1971 | Fisher | |
| 3,693,840 | A | 9/1972 | Starr | |
| 5,234,094 | A | 8/1993 | Weyermann et al. | |
| 5,495,987 | A * | 3/1996 | Slaby | A01F 25/2027 241/101.77 |

(Continued)

*Primary Examiner* — Glenn F Myers

(74) *Attorney, Agent, or Firm* — Luedeka Neely, P.C.; Mark P. Crockett

(57) ABSTRACT

A funnel bucket apparatus is configured to be mountable to typical loader machinery for depositing flowable material at a deposit site. The apparatus includes a bucket and a funnel cover connected by hinges, a discharge chute attachment, a bucket vibrator, and a hydraulic actuator system. An operator controls the actuator system to move the bucket and funnel cover between open and closed positions such that the bucket retains typical loading functions while the apparatus is in the open position. When the bucket is loaded with material, the operator controls the actuator system to move the apparatus into the closed position and positions the apparatus over the deposit site. Material flows through a discharge opening in the funnel cover, through the discharge chute attachment, and down to the deposit site. Efficient and controllable flow rate of material may be facilitated by the bucket vibrator.

5 Claims, 6 Drawing Sheets

(56) References Cited

U.S. PATENT DOCUMENTS

| | | | | |
|---|---|---|---|---|
| 5,692,875 | A | 12/1997 | Boman | |
| 5,829,949 | A * | 11/1998 | Brown | E02F 3/4075 141/10 |
| 5,885,053 | A * | 3/1999 | Deye | E04G 21/025 414/722 |
| 6,662,480 | B1 * | 12/2003 | Stevens | E02F 3/815 37/444 |
| 6,969,226 | B2 * | 11/2005 | Raley | E04G 21/0481 37/903 |
| 7,278,804 | B2 | 10/2007 | Deal et al. | |
| 7,540,398 | B2 | 6/2009 | Medemblik | |
| 7,934,899 | B2 | 5/2011 | Downing | |
| 9,580,874 | B2 | 2/2017 | Millsaps et al. | |
| 2005/0169739 | A1 | 8/2005 | Raley | |
| 2006/0239806 | A1 | 10/2006 | Yelton | |
| 2016/0129823 | A1 * | 5/2016 | Millsaps, II | B65G 41/002 414/505 |
| 2019/0255982 | A1 * | 8/2019 | O'Neill | B60P 7/132 |
| 2023/0047650 | A1 | 2/2023 | Hefner | |

* cited by examiner

APPARATUS AND METHOD FOR STEMMING BLAST HOLES

FIELD

This invention relates to the field of construction. More particularly, this invention relates to an apparatus and method for transporting and delivering flowable materials at a construction site, such as for depositing stemming materials into a blast hole at a blasting site.

BACKGROUND

Explosive blasting in construction and mining operations requires drilling a large number of blast holes into the ground, placing explosive charges into the holes and then detonating the charges. The explosion fragments solid rock by sending shock waves through the ground, which makes the process of removing the rock significantly easier.

Before the explosives are detonated, the blast holes are covered with non-volatile matter, such as crushed gravel and water, in a process commonly referred to as stemming. Each of the blast holes is stemmed to prevent high velocity explosive blast gases from escaping through the top of the blast holes. The practice also allows for better ejection control, which is important in terms of controlling debris from leaving the blast zone. Additionally, applying stemming on top of the explosive agent increases the fragmentation of the rock while decreasing the noise generated by the blast.

However, given the large number of blast holes that are present at each blast site, the stemming process has historically been rudimentary, very labor intensive, and time consuming. Prior stemming practices have involved manually shoveling the stemming material into five-gallon buckets from a material pile located near the blasting location and carrying the filled buckets to the holes to be stemmed. This method has many disadvantages, such as strain on laborers caused by shoveling large quantities of material and carrying filled buckets over harsh terrain, the waste of stemming material associated with the filling and transportation of the buckets, time inefficiencies involved in a labor-intensive manual process, and increased manpower needed to complete the process in a timely manner.

Another similar method involves using smaller stemming piles located closer to each blasting hole. This method reduces the need for carrying buckets, but it still requires many laborers to perform manual shoveling, wastes a significant amount of the stemming material, and requires more time to complete the stemming process.

Some effective solutions for minimizing time and effort associated with stemming include using specialized standalone stemming apparatuses-similar to functional trailers—that may be deposited at a site, oftentimes filled with stemming material using typical machinery like front end loaders, track hoes, skid loaders, etc. However, it may be inconvenient or impossible to transport standalone stemming apparatuses to remote job sites. Moreover, such standalone stemming apparatuses tend to be expensive. In these cases, it would be preferable to use typical machinery, such as front-end loaders, track hoes, and skid loaders, to carry out the stemming process in addition to their typical functions.

Accordingly, there is a need for an apparatus that enables stemming material to be quickly and conveniently poured into a blast hole using typical machinery. The needed apparatus would be both inexpensive and engageable with standard factory-provided bucket mounting and maneuvering systems.

SUMMARY

Described herein is a material delivery apparatus, referred to herein as a funnel bucket, that can be mounted to and maneuvered by typical transport machinery, such as front end loaders, track hoes, and skid steer loaders. A preferred embodiment of the funnel bucket includes two main parts: a bucket and a funnel cover. One use of the funnel bucket apparatus is for depositing a flowable material into a blast hole at a blasting site to fill the hole after the explosive charge has been loaded, which is also referred to as stemming the hole. The flowable material that stems the hole is also referred to herein as stemming material. Embodiments of the funnel bucket described herein may include several other components for facilitating an effective rate of loading and deposition of stemming material, including a hydraulic actuator system, one or more discharge chute attachments, and a bucket vibrator.

As one of ordinary skill in the art will appreciate, there are several benefits provided by the embodiments of the funnel bucket apparatus described herein. Firstly, it allows one operator to complete the tasks previously performed by three to four people, and those tasks can be performed in less time and with a lower potential for workplace injuries. Thus, use of the funnel bucket apparatus described herein is more time efficient and labor efficient than conventional stemming processes, while also increasing workplace safety. Secondly, the operator can better monitor the flow of stemming material into the blast hole, which helps avoid a blockage in the hole that can prevent proper stemming. By ensuring proper stemming, the funnel bucket apparatus described herein helps to prevent potential fly rock/debris from leaving the blast zone and helps to get proper breakage of the rock during the blast. Thirdly, use of the funnel bucket apparatus described herein prevents waste of stemming material, because only one large pile of stemming material is used for filling multiple blast holes, rather than several small piles scattered throughout the blast zone. Since there is no need for workers to manually fill and carry buckets of stemming material, less material is wasted by inadvertent spillage on the ground during shoveling or transport.

Preferred embodiments of the invention are directed to a funnel bucket apparatus that includes a bucket, a funnel cover, and a hinge mechanism that pivotally connects the funnel cover to the bucket. The bucket has an attachment mechanism that attaches the bucket to a transport machine. The funnel cover includes a cover portion, a funnel portion, and a discharge opening in the funnel portion. An actuator system connected to the bucket and the funnel cover is configured to move the funnel cover between open and closed positions with respect to the bucket.

In some embodiments, the funnel bucket apparatus includes a bucket vibrator attached to the bucket or the funnel cover.

In some embodiments, the funnel bucket apparatus includes one or more discharge chute attachments configured for removable attachment to the funnel portion adjacent the discharge opening.

In some embodiments, the actuator system comprises a hydraulic cylinder having a first clevis end attached to the funnel cover and a second clevis end attached to the bucket.

In some embodiments, the funnel bucket apparatus includes a gate that is movably attached to the funnel portion. The gate is operable to move to multiple positions in which the gate at least partially covers the discharge opening by different amounts.

Some embodiments are directed to a method for depositing stemming material in a blast hole using the funnel bucket apparatus. The method includes:

(a) attaching the funnel bucket apparatus to the transport machine;
(b) maneuvering the transport machine to a pile of the stemming material;
(c) controlling the actuator system to move the funnel cover to the open position;
(d) maneuvering the transport machine to scoop a quantity of the stemming material into the bucket while the funnel cover is in the open position;
(e) controlling the actuator system to move the funnel cover to the closed position;
(f) maneuvering the transport machine to a blast hole to be stemmed;
(g) maneuvering the transport machine to align the discharge opening with the blast hole;
(h) controlling the transport machine to tilt the bucket into a discharge position in which the stemming material in the bucket flows through the discharge opening into the blast hole;
(i) flowing the stemming material into the blast hole until the blast hole is filled; and
(j) controlling the transport machine to tilt the bucket into a holding position in which the stemming material in the bucket stops flowing through the discharge opening.

In some embodiments, the gate of the funnel bucket apparatus is operable to move to multiple positions in which the gate at least partially covers the discharge opening by different amounts, and the method includes moving the gate to one of the multiple positions to affect flow of the stemming material through the discharge opening.

In some embodiments, the bucket vibrator is attached to the funnel cover, and the method includes operating the bucket vibrator to affect flow of the stemming material through the discharge opening.

In some embodiments, the discharge chute attachment is attached to the funnel portion adjacent the discharge opening, and the method includes flowing the stemming material through the discharge opening and the discharge chute attachment.

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
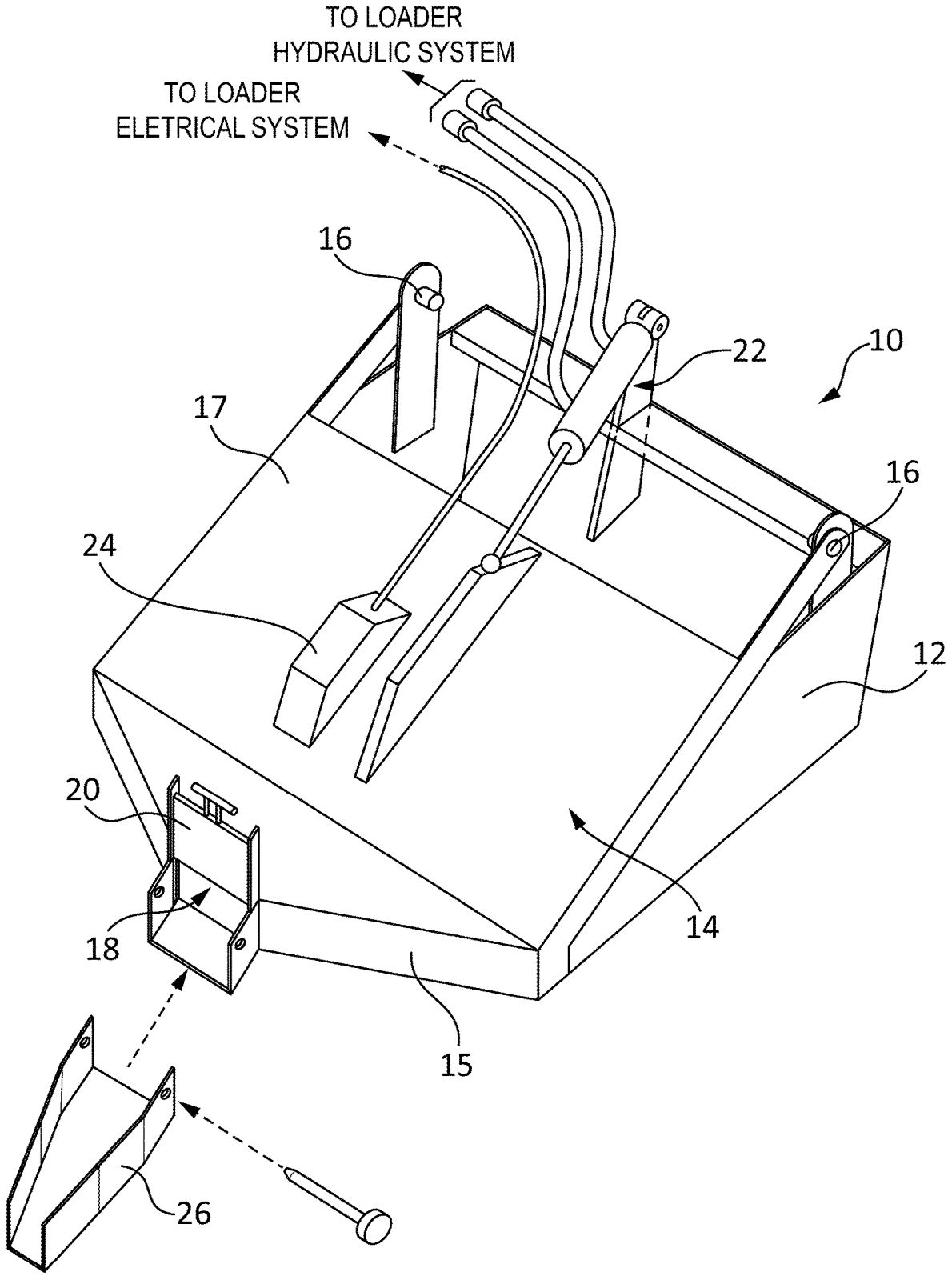
FIG. 1 depicts a funnel bucket in the closed position according to an embodiment of the invention.

FIG. 1 shows one embodiment of a funnel bucket apparatus 10 of the present disclosure, generally including a bucket 12 and a funnel cover 14 that are pivotally connected via hinges 16. The bucket 12 includes an industry standard attachment mechanism that attaches the bucket 12 to a transport machine, such as a frontend loader. The funnel cover 14 includes a cover portion 17 and a funnel portion 15. Centrally disposed in the funnel portion 15 is discharge opening 18 through which stemming material may flow. The bucket 12 and funnel cover 14 are designed to retain the stemming material during transport between blast holes, and while stemming material is being discharged via the discharge opening 18. The size, dimensions, and shape of the bucket 12 and the funnel cover 14 may take various optimal forms for different tasks and materials, but generally they are closely dimensioned for each other to ensure retention of material within the bucket 12 when the cover 14 is closed. As shown in FIG. 1, various other components may be configured to attach and engage with either or both of the bucket 12 and funnel cover 14.

In some embodiments, the bucket 12, funnel cover 14, and various other components may be formed from stainless steel or other similar materials with like suitable properties. Stainless steel is highly durable and is suitable for withstanding both extreme environmental conditions and the extreme wear associated with harsh uses like grading and stemming, which require contact with highly abrasive materials. In some embodiments, in order to transport bulk explosives and other volatile materials, the bucket 12, funnel cover 14, and various other components (such as cutting edges on the bucket 12) may be formed entirely or partly from non-sparking materials, such as nonferrous metals, nylon, polyethylene, polyurethane or other similar materials with like suitable properties. Accordingly, a funnel bucket apparatus 10 made from suitable materials can be used for multiple purposes, including grading, stemming, and bulk explosives loading.

Figure 6:
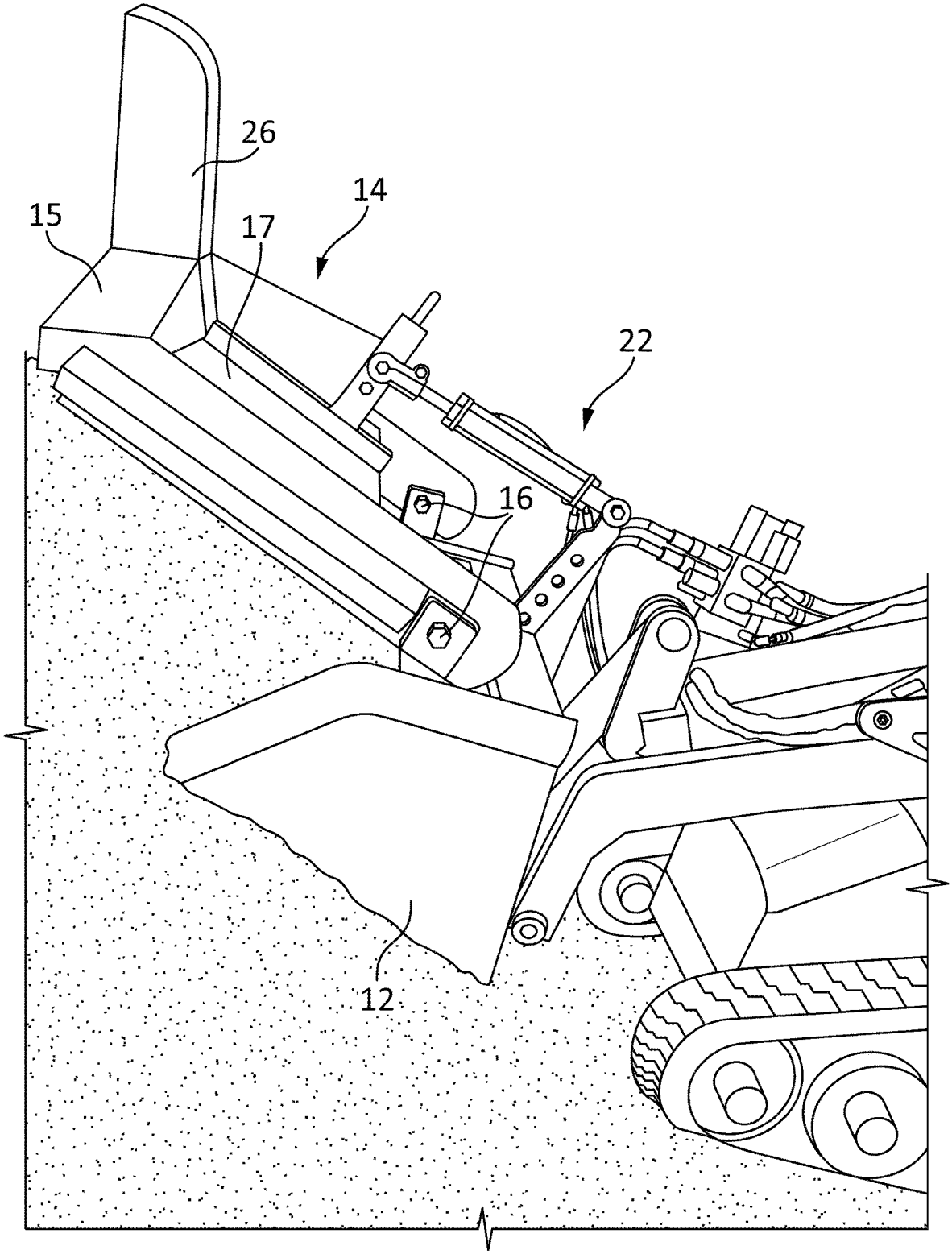
FIG. 6 depicts the funnel bucket in the open position while scooping crushed gravel according to an embodiment of the invention.
Figure 7:
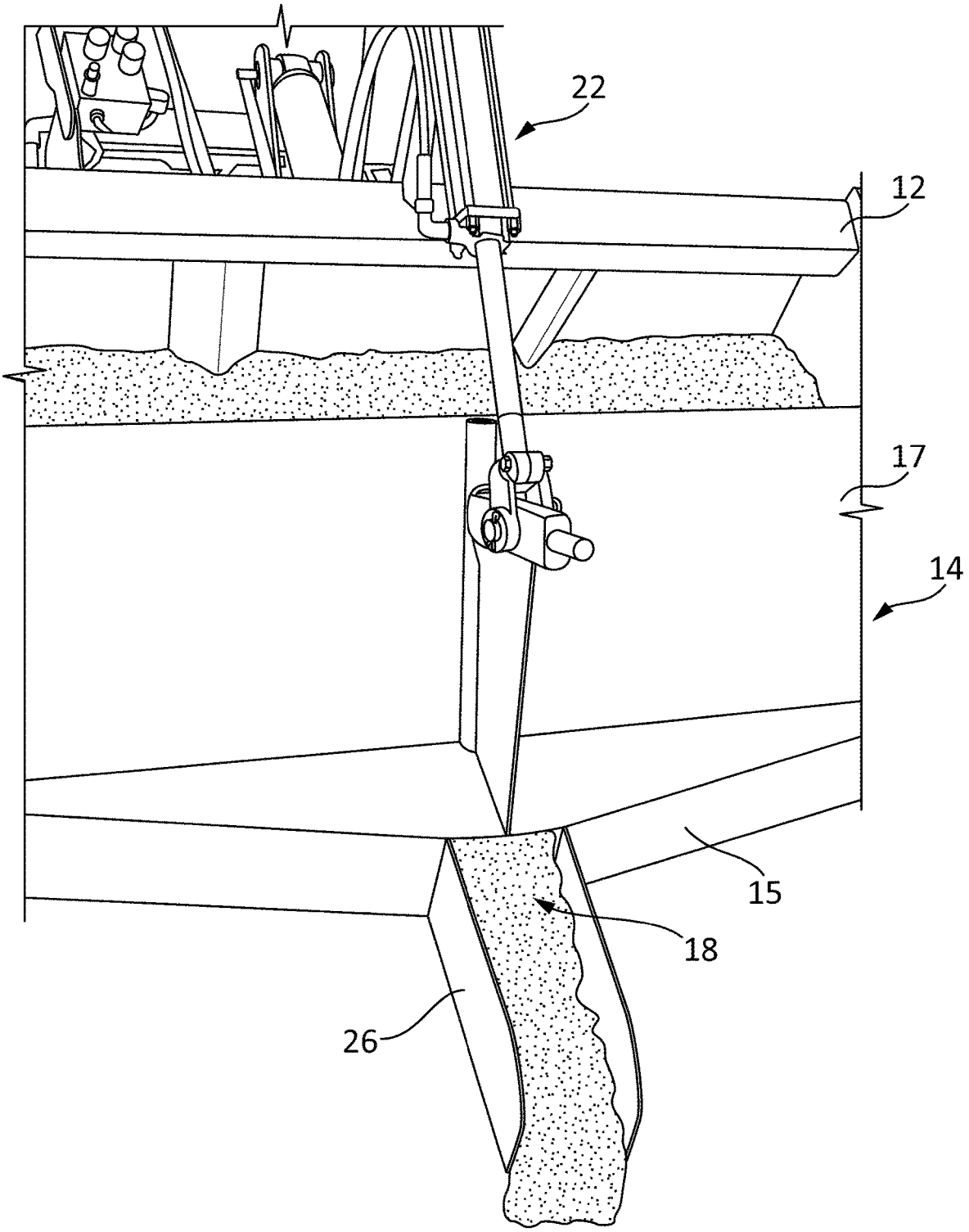
FIG. 7 depicts the funnel bucket in the closed position with crushed gravel exiting the discharge chute attachment according to an embodiment of the invention.

The funnel bucket apparatus 10 is a comprehensive solution—a single piece of equipment performing the functions of several. Using the funnel bucket apparatus 10, an operator can scoop and load material, transport the material to a blast hole, and deposit the material therein. This multifunctionality is a virtue of versatility and maneuverability, which allows an operator to transition the funnel bucket apparatus 10 between open and closed positions as well as maneuver the apparatus as he would any other bucket. Thus, as shown in FIGS. 6 and 7, without leaving the seat of the loader to which the funnel bucket apparatus 10 is attached, an operator can open the funnel cover 14, use the bucket 12 to gather stemming material just as a normal bucket would be used, close the funnel cover 14 to retain material, drive to a blast hole, and then lift, lower, tilt, or otherwise position the apparatus and deposit the stemming material in the blast hole at a desired rate.

In the embodiment depicted in FIG. 1, the funnel cover 14 may be opened and closed using an actuator system 22 attached between the bucket 12 and the funnel cover 14. In a preferred embodiment, the actuator system 22 comprises a hydraulic arm having a first clevis end attached to the bucket 12 and a second clevis end attached to the funnel cover 14. In response to the actuator system 22, the funnel cover 14 and bucket 12 move relative to each other constrained by the hinges 16 located at either end of the width of the bucket 12. In variations of this embodiment, additional hinges may be located elsewhere along the width of the bucket 12 and funnel cover 14. In some embodiments, the actuator system 22 is a unit that is separate from the hydraulic system of the loader to which the funnel bucket apparatus 10 is attached. In some embodiments, the actuator system 22 is coupled to the existing hydraulic system of the loader.

Some embodiments include one or more discharge chute attachments 26 that control how stemming material is deposited via the discharge opening 18. The dimensions and features of the discharge chute attachments 26 may be selected to optimize numerous variables associated with the discharge of stemming material via the discharge opening 18 and guidance of the material through the discharge chute attachments 26. For example, the dimensions may be varied to produce a desirable rate of deposition of stemming material depending on the type of material being deposited, the dimensions of the blast hole in which material is being deposited and the size of material being deposited, and to control many other variables not mentioned herein. In some embodiments, a discharge chute attachment 26 is permanently affixed to the funnel portion 15 or to the bucket 12 at a location corresponding the to the discharge opening 18. In other embodiments, the discharge chute attachment 26 is configured to releasably engage the funnel portion 15 through various means, including a pin and hole (one embodiment of which is illustrated in FIG. 1), latch, nut and bolt, screw, or other attachment structures. In a preferred embodiment, the pin that attaches the discharge chute attachment 26 to the funnel portion 15 also serves as a hinge that allows the discharge chute attachment 26 to be rotated to an upward position in which it does not cover the discharge opening 18 and affect the flow of stemming material. This may be desirable when stemming larger holes.

The discharge chute attachment 26 may also be configured to engage with other structures located on the funnel cover 14. In some embodiments, the funnel cover 14 may have a pronounced ledge extending from the location of the discharge opening, configured to releasably engage with the discharge chute attachment 26 through various means.

In some embodiments, discharge of stemming material via the discharge opening 18 and the discharge chute attachment 26 may also be controlled via a movable gate 20 attached to the funnel cover 14. The gate 20 is operable to move to and be secured in multiple positions in which the gate 20 at least partially covers the discharge opening 18 by different amounts.

Some embodiments of the funnel bucket apparatus 10 may include one or more bucket vibrators 24 that vibrate the bucket 12 to facilitate a uniform rate of flow of stemming material via the discharge opening 18 and to prevent clumps of material from clogging the discharge opening 18. The bucket vibrator 24 may be disposed at various locations on the funnel cover 14 or the bucket 12, and either internally or externally located depending on the material being deposited. In one embodiment depicted in FIG. 1, the bucket vibrator 24 may be located on an outside surface of the funnel cover 14 proximal to the discharge opening 18 to facilitate the most efficient rate of deposition of stemming material. In some embodiments, the bucket vibrator 24 may be a hydraulic vibrator, either separate from the hydraulic system of the loader to which the funnel bucket apparatus 10 is attached or coupled to an existing hydraulic system of the loader. In other embodiments, the bucket vibrator 24 may be electrically operated, powered either by a battery or by wiring the vibrator 24 to the electrical system of the loader to which the funnel bucket apparatus is attached.

Figure 2:
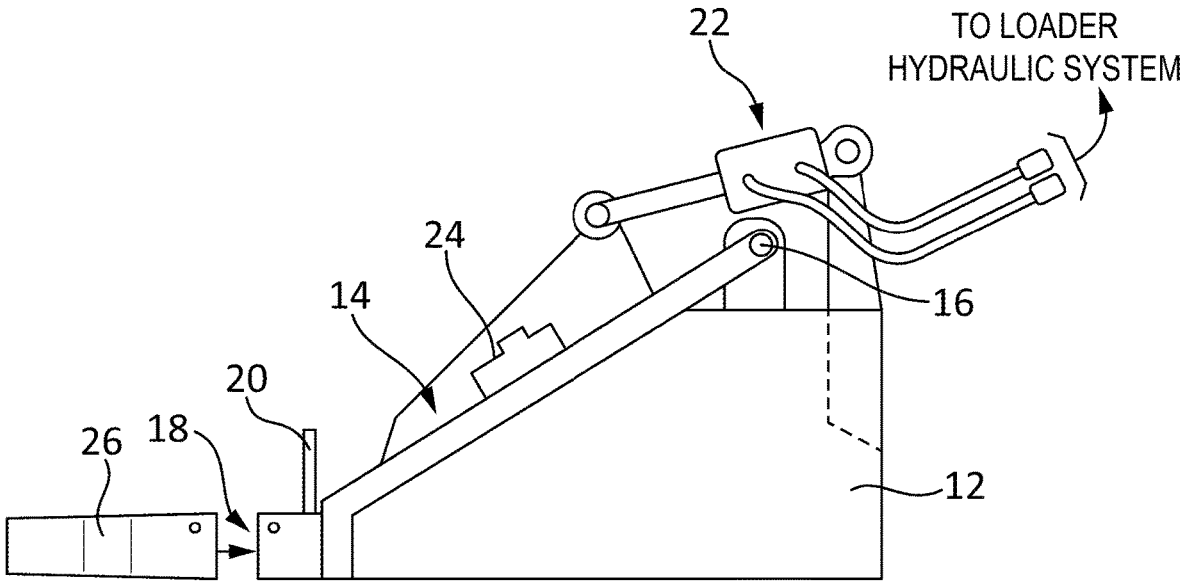
FIG. 2 depicts a side view of the funnel bucket in the closed position with a discharge chute attachment according to an embodiment of the invention.
Figure 3:
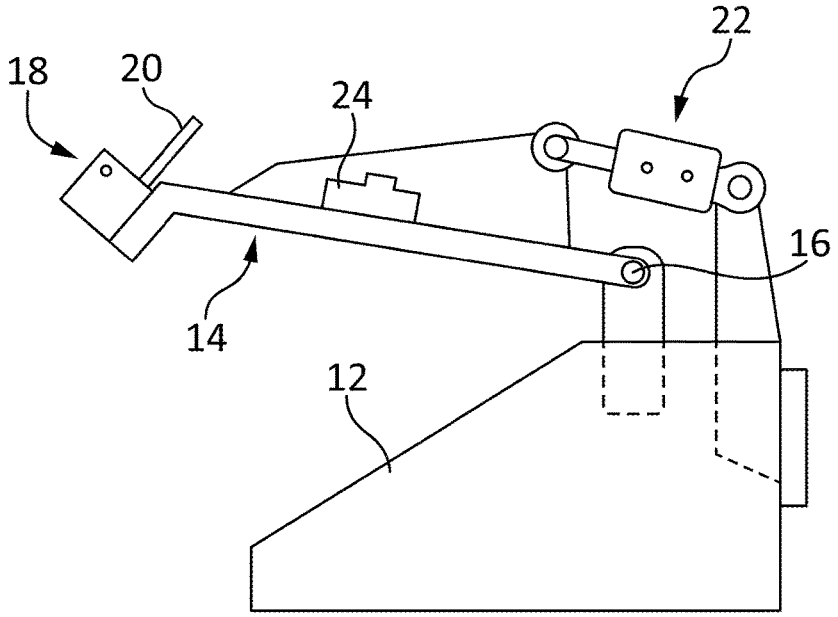
FIG. 3 depicts a side view of the funnel bucket in the open position according to an embodiment of the invention.

In operation, when attached to factory mounts and the hydraulic system of a typical loader, an operator controls the actuator system 22 to move the funnel cover 14 of the funnel bucket apparatus 10 into an open position, as shown in FIG. 6. The open position of the funnel cover 14 is also shown from various angles in FIGS. 3-5. The operator then maneuvers the bucket 12 into a suitable position for scooping a load of gravel or other material as shown in FIG. 6. Upon the collecting the stemming material, the operator controls the actuator system 22 to move the funnel cover 14 into a closed position as shown in FIGS. 1, 2 and 7, so that the stemming material is retained within the bucket 12 and cannot spill out. The operator then positions the discharge chute attachment 26 over a blast hole to be filled, tilts the bucket 12 downward, and opens the gate 20, thereby allowing the gravel or other material to flow from the discharge opening 18 and into the blast hole, as shown in FIG. 7. In some situations, the bucket vibrator 24 may also be activated to promote even flow of stemming material from the bucket 12 into the discharge opening 18.

Figure 4:
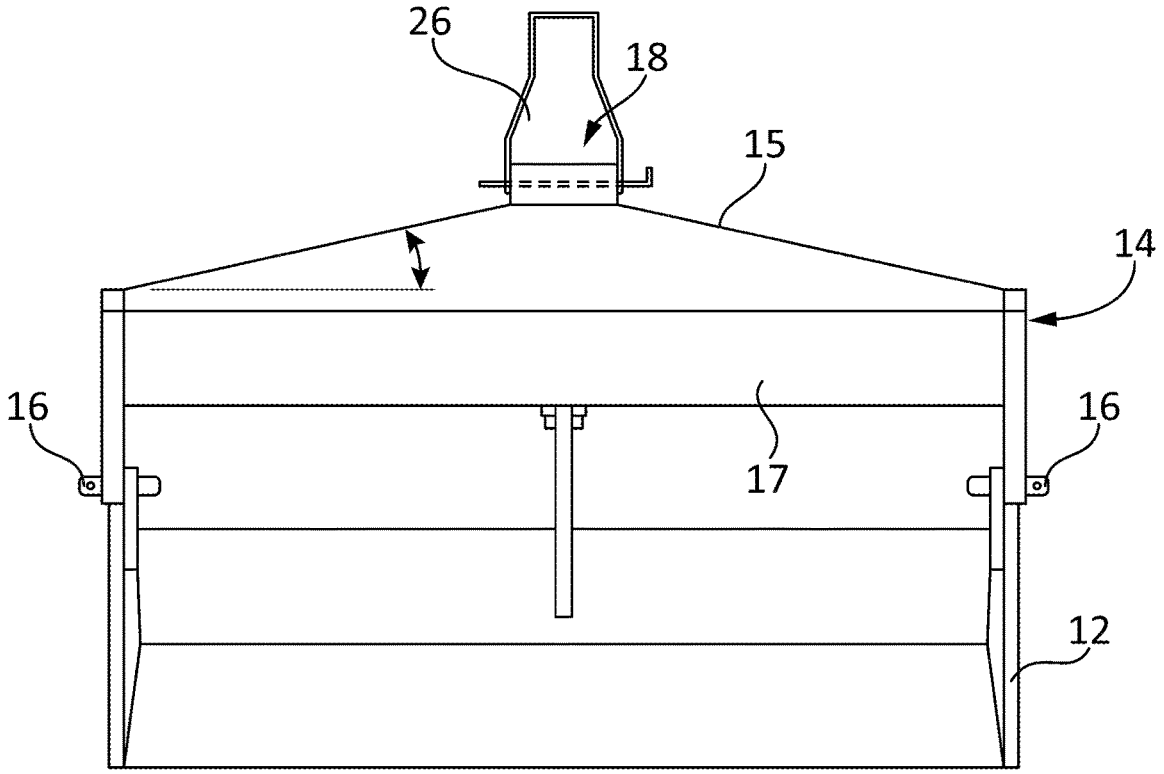
FIG. 4 depicts a front view of the funnel bucket in the open position according to an embodiment of the invention.
Figure 5:
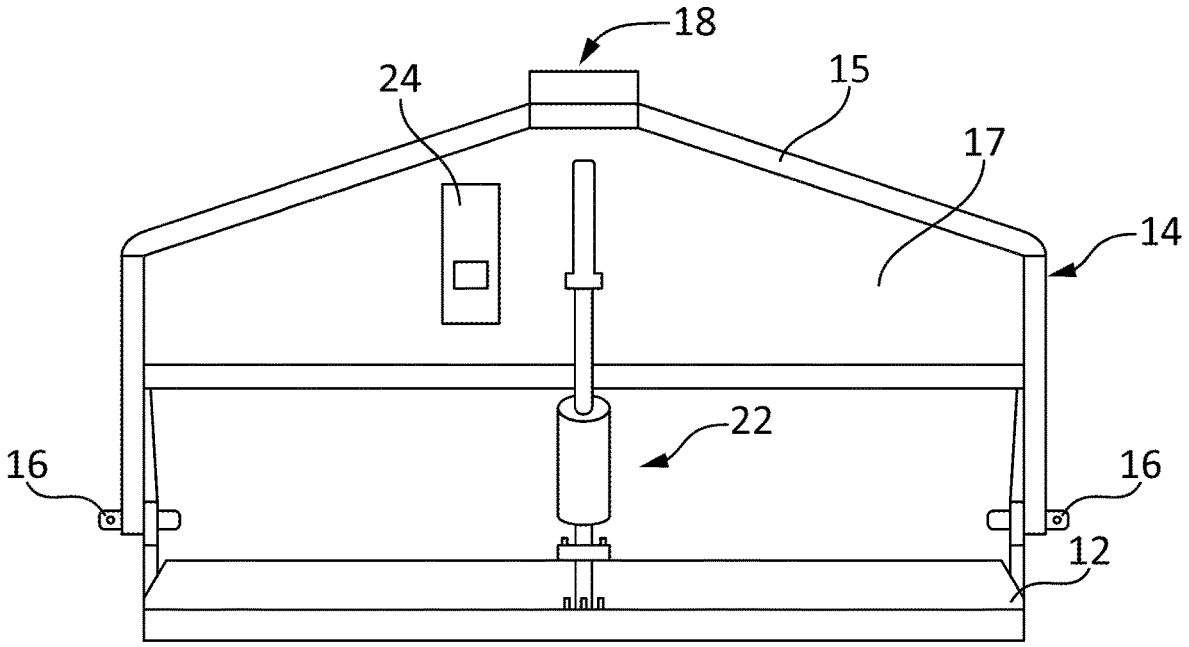
FIG. 5 depicts a top-down view of the funnel bucket in the open position according to an embodiment of the invention.

With regard to the funnel angle depicted in FIG. 4, it will be appreciated that the value of this angle is selected to enhance the flowability of stemming material, such as crushed stone which has a relatively high angle of repose (approximately 45 degrees). It is important to select a funnel angle that is large enough to prevent the stemming material from getting stuck and to aid in the flow of material. The angle is preferably steep enough to aid in the flow of material but not so steep as to cause the bucket to be excessively long or to cause the material trajectory to be too long as it exits the bucket. It will be appreciated that if the angle is too steep, although the material flows well, the machine will be awkwardly long, which can hinder navigability and the ability to easily align with the hole to be stemmed. Accordingly, the choice of the funnel angle should balance the two needs.

Figure 8:
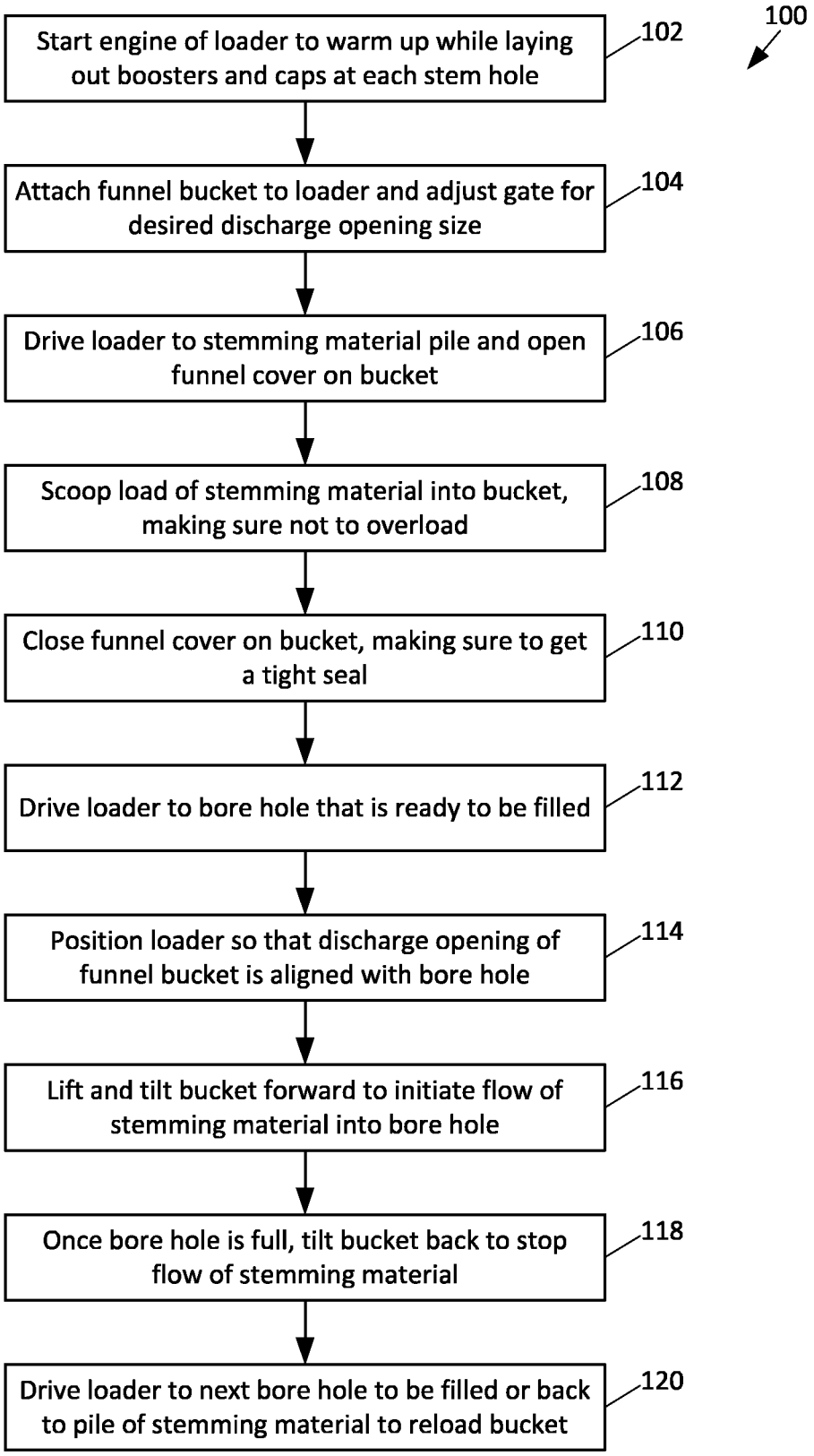
FIG. 8 depicts steps of a process for using the funnel bucket to deposit stemming material into a blast hole.

FIG. 8 lists steps in an embodiment of a process 100 for using the funnel bucket apparatus 10 to deposit material in a blast hole on a construction site. An operator starts the engine of the frontend loader or other skid-steer machine to allow it to warm up while boosters and caps are laid out at each blast hole to be stemmed (step 102). The boosters and caps are loaded, and the tail ends of the caps are neatly set to the side of each hole so as not to interfere with the maneuvering of the loader around the job site. If not already attached, the funnel bucket apparatus 10 is then attached to the loader's quick-connection attachment setup, and the operator adjusts the position of the gate 20 to attain the proper size of the discharge opening 18 for the stemming materials to be poured (step 104). The operator then maneuvers the loader to approach the pile of stemming material and uses the loader's hydraulic controls to open the funnel cover 14 (step 106). With the funnel cover 14 in the open position, the operator maneuvers the loader and bucket to take a scoop of the stemming material from the pile, while making sure not to overload the bucket which may prevent a tight and proper seal when the funnel cover 14 is lowered into the closed position (step 108). Using the hydraulic controls of the loader, the operator tilts the bucket back into the holding position and lowers the funnel cover 14 into the closed position, making sure there is a solid seal between the funnel cover 14 and the lip of the bucket 12 to avoid spilling of the stemming material (step 110). The operator then drives the loader to one of the blast holes that has been loaded with explosive agent but has not yet been stemmed (step 112). Depending on the pattern and distance between holes, the loader can be driven between rows or over holes that have already been stemmed. The operator then maneuvers the loader so that the discharge chute attachment 26 is aligned with the blast hole to be filled (step 114). Using the hydraulic controls of the loader, the operator lifts the bucket 12 and tilts it forward into the discharge position to initiate the flow of stemming material through the discharge chute attachment 26 into the blast hole (step 116). Once the blast hole has been filled to the desired level with stemming material, the operator uses the hydraulic controls of the loader to tilt the bucket 12 back into the holding position to stop the flow of the material (step 118). The operator may also lower the funnel cover 14 into the closed position at this point to prevent spillage of stemming material while driving the loader to the next blast hole to be filled or back to the pile of stemming material to reload bucket (step 120).

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A funnel bucket apparatus comprising:

a bucket having an attachment mechanism that attaches the bucket to a transport machine;

a funnel cover comprising a cover portion, a funnel portion, and a discharge opening in the funnel portion;

a hinge mechanism that pivotally connects the funnel cover to the bucket;

an actuator system configured to move the funnel cover between open and closed positions with respect to the bucket, the actuator system comprising a hydraulic cylinder having a first clevis end attached to the funnel cover and a second clevis end attached to the bucket;

a bucket vibrator attached to the bucket or the funnel cover;

one or more discharge chute attachments configured for removable attachment to the funnel portion adjacent the discharge opening; and a gate movably attached to the funnel portion, the gate operable to move to multiple positions in which the gate at least partially covers the discharge opening by different amounts.

2. A method for depositing stemming material in a blast hole using the funnel bucket apparatus of claim 1, comprising:

(a) attaching the funnel bucket apparatus to the transport machine;

(b) maneuvering the transport machine to a pile of the stemming material;

(c) controlling the actuator system to move the funnel cover to the open position;

(d) maneuvering the transport machine to scoop a quantity of the stemming material into the bucket while the funnel cover is in the open position;

(e) controlling the actuator system to move the funnel cover to the closed position;

(f) maneuvering the transport machine to a blast hole to be stemmed;

(g) maneuvering the transport machine to align the discharge opening with the blast hole;

(h) controlling the transport machine to tilt the bucket into a discharge position in which the stemming material in the bucket flows through the discharge opening into the blast hole;

(i) flowing the stemming material into the blast hole until the blast hole is filled; and (j) controlling the transport machine to tilt the bucket into a holding position in which the stemming material in the bucket stops flowing through the discharge opening.

3. The method of claim 2 further comprising moving the gate to one of the multiple positions to affect flow of the stemming material through the discharge opening.

4. The method of claim 2 further comprising operating the bucket vibrator to affect flow of the stemming material through the discharge opening.

5. The method of claim 2 further comprising flowing the stemming material through the discharge opening and through an attached one of the one or more discharge chute attachments.

* * * * *